US006951035B2

(12) United States Patent
Kinchen et al.

(10) Patent No.: US 6,951,035 B2
(45) Date of Patent: Oct. 4, 2005

(54) PROTECTIVE CUSHION

(76) Inventors: Darlene L. Kinchen, 1711 E. 10th St., Winston-Salem, NC (US) 27101; Charles H. Cession, 582 Darkbridge Rd., Rural Hall, NC (US) 27045

( * ) Notice: Subject to any disclaimer, the term of this patent is extended or adjusted under 35 U.S.C. 154(b) by 0 days.

(21) Appl. No.: 10/304,990

(22) Filed: Nov. 26, 2002

(65) Prior Publication Data

US 2003/0097713 A1 May 29, 2003

Related U.S. Application Data

(60) Provisional application No. 60/333,330, filed on Nov. 26, 2001.

(51) Int. Cl.[7] ..... A47G 9/06

(52) U.S. Cl. ..... 5/420; 5/655.9

(58) Field of Search ..... 5/417, 420, 652, 5/657, 655.9; 40/320; 297/228.11, 219.1

(56) References Cited

U.S. PATENT DOCUMENTS

| | | | | | |
|---|---|---|---|---|---|
| 3,259,925 | A | | 7/1966 | Tilles | |
| 3,262,134 | A | * | 7/1966 | Bramble, Jr. | 5/420 |
| 3,319,273 | A | * | 5/1967 | Solin | 5/420 |
| 3,659,297 | A | | 5/1972 | Schulz | |
| 4,190,918 | A | | 3/1980 | Harvell | |
| 4,637,151 | A | * | 1/1987 | Love et al. | 40/584 |
| 4,768,245 | A | * | 9/1988 | Dutton | 5/636 |
| 4,843,662 | A | * | 7/1989 | Handelman | 5/653 |
| 4,853,994 | A | | 8/1989 | Ekstein | |
| 4,863,003 | A | * | 9/1989 | Carter | 190/8 |
| 4,874,340 | A | | 10/1989 | Smallwood | |
| 5,168,590 | A | * | 12/1992 | O'Sullivan | 5/490 |
| 5,203,041 | A | * | 4/1993 | Alonso | 5/420 |
| 5,454,125 | A | * | 10/1995 | Ratkowski | 5/417 |
| 5,491,851 | A | * | 2/1996 | Alonso | 5/722 |
| 5,534,100 | A | * | 7/1996 | Mitchell | 156/230 |
| 5,572,758 | A | * | 11/1996 | Merritt | 5/653 |
| 5,573,288 | A | | 11/1996 | Raffensperger | |
| 5,611,414 | A | * | 3/1997 | Walker | 190/2 |
| 6,026,525 | A | | 2/2000 | Davis | |
| 6,088,857 | A | * | 7/2000 | Ogle | 5/722 |
| 6,272,704 | B1 | * | 8/2001 | Cutler | 5/655 |

FOREIGN PATENT DOCUMENTS

| | | |
|---|---|---|
| EP | 0004996 | 10/1979 |
| EP | 0707822 | 4/1996 |
| GB | 2130085 | 5/1984 |
| GB | 2168290 | 6/1986 |

OTHER PUBLICATIONS

International Search Report mailed Apr. 4, 2003 corresponding to PCT/US 02/37704.

* cited by examiner

*Primary Examiner*—Michael Safavi
(74) *Attorney, Agent, or Firm*—Kilpatrick Stockton LLP

(57) ABSTRACT

A protective cushion includes an outer shell enclosing a pad comprising high-density foam. The cushion provides protection to a user's knees, such as while praying or meditating. The outer shell of the cushion is water-resistant, stain-resistant, and able to withstand excessive wear and tear. Further, the outer shell comprises designs, pictures, and text to aid the user in prayer or other worship activities. The cushion can be foldable and portable with a carrying handle provided for this purpose.

8 Claims, 5 Drawing Sheets

PROTECTIVE CUSHION

CROSS REFERENCE TO RELATED APPLICATIONS

This application claims priority to U.S. Provisional Application No. 60/333,330 filed Nov. 26, 2001, the disclosure of which is herein incorporated by reference.

FIELD OF THE INVENTION

This invention relates generally to the field of protective cushions, and in particular to protective cushions that protect the knees, shins and feet while kneeling or sitting cross-legged on a hard surface, such as a floor.

BACKGROUND OF THE INVENTION

Pillows and cushions are often used to provide proper anatomical alignment and to protect sensitive body parts. A traditional pillow used on a bed protects one's head while sleeping. Cushions on a couch protect one's body and legs while seated. Rubber cushions are used to protect one's feet and spine while standing for extended periods of time, for example at work stations, behind a bar, and in a restaurant kitchen. Such cushions provide comfort and support to users in activities of daily living by providing protection from surroundings and environmentally-induced stress.

Knees and shins are sensitive parts of the human body that require some type of protection in many activities. For example, many people have knee problems ranging from stiffness or discomfort, to extreme pain and immobility. Knee sensitivities necessitating protection are caused by a variety of situations, for example, sports injuries, overuse, arthritis, and improper weight distribution. Therefore, when engaging in an activity that stresses the knee, such as kneeling to pray or meditate, a cushion designed to protect this sensitive and injury-prone body part would be beneficial.

During prayer or meditation, various articles will facilitate such activity if they are readily accessible. For example, a bible, or other religious text, prayer cards, religious artifacts, and the like are used in prayer and/or similar worship activities where kneeling is involved. A convenient place to store such articles, preferably accessible to a person while kneeling, would be beneficial.

Worship is defined as the ceremonies, prayers, and other religious forms by which the reverent love and devotion to a deity, an idol, or a sacred object is expressed. Worship includes, for example, praying, singing, participating in liturgical exercises, and other public and private spiritual ceremonies and rituals.

Visual aids are useful in assisting worshipers to focus their thoughts or as a reminder of their prayer commitment. Religiously themed pictures or drawings and/or passages of scripture are useful for this purpose.

Currently, people who need protection for their knees while praying or kneeling to worship must use a conventional pillow from a bed, an accessory pillow from an article of furniture, or other decorative cushion. Such approaches to knee protection are inadequate. A traditional pillow is bulky and lacks sufficient strength and durability to withstand the forces exerted by a kneeling person. Moreover, a bed pillow or decorative cushion tends to become easily soiled or otherwise sustain damage to the fabric when used in conjunction with kneeling repeatedly on a floor in a public place of worship. Accessory cushions are generally made of soft foam which can deform and tear, and their covers are susceptible to soiling and staining. Conventional pillows and cushions do not provide the support and durability required for repeated kneeling activities, such as praying. Additionally, conventional pillows and cushions do not provide pockets and storage devices sufficient to hold desired accessories.

Bed pillows and accessory cushions are often heavy and undesirably bulky or of inappropriate colors to transport and use in a place of worship. They soil easily and are not sufficiently strong to withstand constant use on a floor. Conventional pillows also do not provide themes that enable a user to focus on prayer or meditation, nor do they provide pockets for the storage of accessories. Therefore, a need exists for a cushion to protect the knee while kneeling to pray or meditate, which is lightweight, foldable, easily carried, strong yet soft, and contains pockets for accessories. Additional benefits would include pictures, drawings, or writing on the face of the cushion.

SUMMARY OF THE INVENTION

A cushion of the present invention provides numerous advantages over conventional cushions and pillows. For example, the present invention advantageously provides relief for a user's knees while the person is kneeling for extended periods of time, such as during prayer, meditation, or other worship activities. In addition to the anatomical relief and support offered by the present invention, the cushion has pockets for accessories, and can be folded or closed for ease of transportation.

Embodiments of a cushion according to the present invention comprise: a cushioning pad; a shell having a top, a bottom, and at least three sides, such that the shell encloses the cushioning pad; and worship-related graphics displayed on the shell top, or outside of the cushion. The cushioning pad comprises a lightweight, high-density foam, which can also be a fire-resistant material. In preferred embodiments, the cushioning pad comprises a thickness of 1.5 to 3 inches.

In embodiments, the top and the bottom of the cushion meet along the sides of the cushion, and include piping along the sides where the top and the bottom meet. The shell can include a means for opening and closing at least one side of the shell for inserting the cushioning pad into and removing the cushioning pad from the shell. In embodiments, the means for opening and closing the at least one side of the shell comprises a zipper.

A cushion of the present invention includes embodiments in which the shell comprises a pocket. The pocket can include a means for displaying selected contents. The cushion can further include a means for closing the pocket. In particular embodiments, the pocket is removably attached to the cushion.

In the present invention, embodiments of worship-related graphics include pictures, words, prayers, other inspirational displays, and combinations of such graphics.

An advantage of the present invention is its durability and stain resistance. The present invention is constructed of materials that will withstand constant use on an abrasive surface such as a hardwood floor. The cushion of the present invention may also be constructed of fabric that is treated with a stain repellant or has stain repellant characteristics.

Another advantage of the present invention is its thin, lightweight, yet resilient cushioning foam. The interior of the cushion includes a high-density, fire retardant, foam. Such high-density foam provides sufficient cushioning to protect user's knees while remaining lightweight and thin to allow easy transport and storage.

Another advantage of the present invention is a means for folding, closing, and carrying the cushion so that it can be transported easily from one location to another. The present invention may be folded in half, and includes a closure device to keep the two halves together in a closed position. Embodiments include a handle to provide a means for carrying the cushion. In embodiments of the present invention, the handle is retractable such that it does not interfere with the use of the cushion or scrape the floor when not being used. In other embodiments, the handle may attach to the cushion in a non-retractable manner, for example, as when sewn to the outside of the cushion or attached with hook-and-loop type fasteners.

Another advantage of the present invention is pockets and storage areas for accessories. Pockets comprise a variety of sizes to hold items such as books, pens, paper, candles, and other small items useful in prayer and/or other worship activities. In embodiments, the pockets include a closing mechanism such as snaps, hook and loop-type fasteners, magnets, ties, zippers, clasps, or other means of closure. The pockets may be attached to the cushion by a variety of means including zippers, snaps, hook and loop-type fasteners, buttons, or pockets may be sewn onto the cushion. Using various means of attachment, the pockets are removable, attached on only one side to fold out, or permanently attached to the cushion.

Another feature and advantage of the present invention is piping surrounding the outer edges of the cushion. The outer edges are formed when fabric is placed over the top and bottom surfaces of a foam cushion, coming together along the sides of the cushion. Piping provides increased wear resistance to the cushion edges. Piping also provides structural support to the cushion and helps maintain the shape of the cushion when a user is kneeling upon it.

Another feature and advantage of the present invention is the graphics and lettering on the cushion surface. Graphics and/or lettering provide an aid to worship and are inspirational to the user.

In an embodiment of the present invention, a protective cushion is provided comprising a cushioning pad foldable upon itself into a closed position, a shell comprising a top and a bottom, the shell substantially surrounding the cushioning pad, graphics disposed on at least one of the top and the bottom of the shell, a seam dividing the foldable cushioning pad in to substantially equal portions, and a closure means for securing the substantially equal portions in the folded together closed position.

In a further embodiment of the present invention, the top of the shell comprises a material selected from at least one of fabric, plastic, leather and vinyl. In another embodiment, the bottom of the shell comprises a material selected from at least one of fabric, plastic, leather and vinyl.

In a further embodiment of the cushion of the present invention, the graphics are printed on the shell. Additionally, in another embodiment the graphics are woven into the shell. In yet a still further embodiment, the graphics are affixed through adhesive to the shell.

In other embodiments of the present invention, the cushioning pad comprises a cushioning material comprising at least one of high-density fire resistant foam, fibrous pillow filling, animal down, or soy husks. In other embodiments, the cushion further comprises reinforcing material along the seam.

In a further embodiment of the present invention, the cushioning pad comprises two substantially equal portions wherein the shells of each portion are affixed to one another along the seam. Additionally, in embodiments of the present invention, the cushion further comprises sides that are substantially perpendicular to, and connected to, the top and the bottom, and wherein piping is disposed along the cushion where the sides meet the top and where the sides meet the bottom.

Preferred embodiments of the present invention include a cushion wherein at least one of the top or bottom of the shell further comprises a pocket. The pocket is comprised of at least one of leather, plastic, vinyl, denim and fabric and is secured to the shell through at least one of snaps, buttons, zipper and hook-and-loop type fastener such that the pocket may be separably attached to the cushion.

In further embodiments of the present invention, at least one of the top or bottom of the cushion further comprises a fold out pocket such that the pocket is attached to the cushion on only one side and may fold out and away from the body of the cushion. In additional embodiments, the fold out pocket further comprises at least one smaller pocket thereon. In still further embodiments the at least one smaller pocket comprises a pocket on the underside of the fold-out pocket. In another aspect of the present invention, the cushion further comprises at least one of a handle and a shoulder strap. In another embodiment the at least one of a handle or a shoulder strap is attached along the seam of the folded cushion. In yet another embodiment of the present invention the at least one of a handle or a shoulder strap is attached to an outer edge of the cushion.

In another aspect of the present invention, the shell further comprises rubber pads on the bottom of the shell to contact the floor during use.

In a still further aspect of the present invention the cushion further comprises a bag surrounding the cushion wherein the bag comprises at least one of a strap or handle.

In yet another aspect of the present invention, a protective cushion is provided comprising, a cushioning pad foldable upon itself into a closed position, a shell comprising a top and a bottom, the shell substantially surrounding the cushioning pad, graphics disposed on at least one of the top and the bottom of the shell, a pocket disposed on at least one of the top and bottom of the shell, a seam dividing the foldable cushioning pad in to substantially equal portions and reinforced with additional material, a closure means for securing the substantially equal portions in the folded together closed position, and wherein at least one of a handle or a shoulder strap is attached to the shell to facilitate handling of the cushion in the folded position.

As will be recognized by those of skill in the art, many different embodiments of a cushion according to the present invention are possible. Additional objects, advantages, and novel features of the invention will be set forth in the detailed description that follows, and will become more apparent to those skilled in the art upon examination of the following or by practice of the invention.

DETAILED DESCRIPTION

Figure 1:
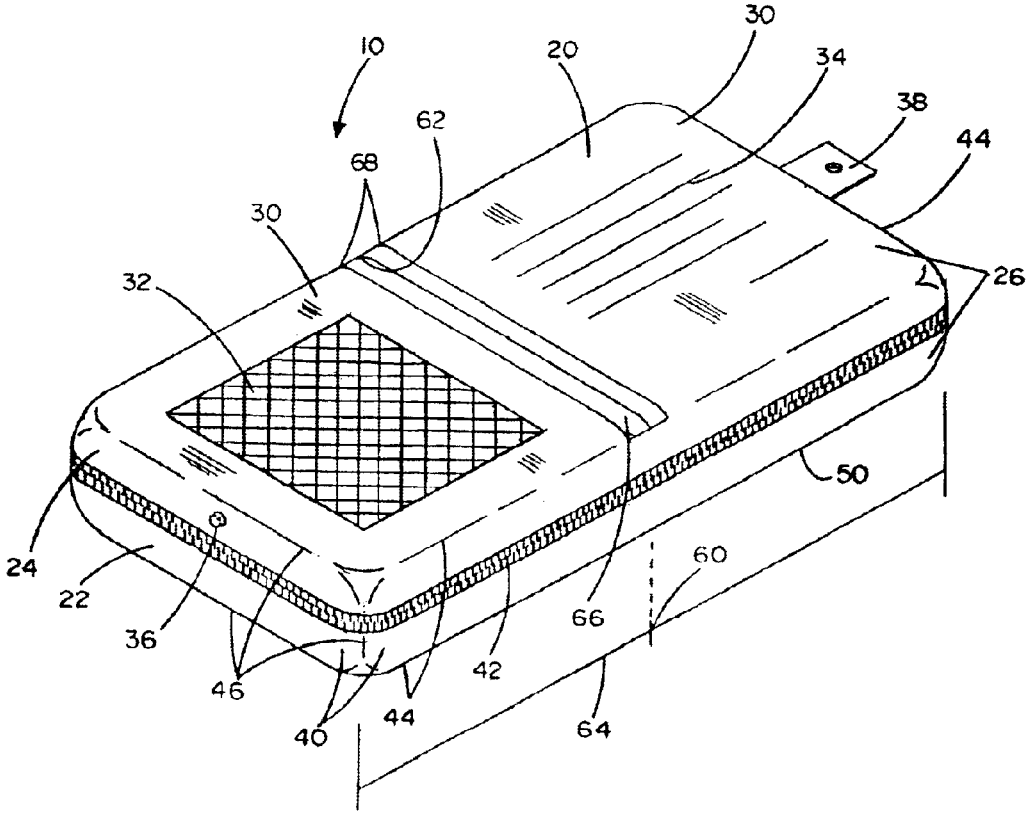
FIG. 1 is a top perspective view of a cushion in an embodiment of the present invention.

FIGS. 1–8 show various aspects of embodiments of the present invention. One embodiment comprises a cushion adapted to protect the knees of a person while kneeling on a hard surface, such as during prayer in a church, synagogue, or mosque, having worship aids integrated with the cushion. FIG. 1 shows one such embodiment.

Referring to FIG. 1, a cushion 10 includes fabric 20 covering a cushioning pad (not shown). Cushion 10 comprises top surface 30, four sides 40, and a bottom surface 50, which together form a substantially rectangular-shaped shell having a volume. Fabric 20 of top surface 30 extends downwardly at approximately right angles from the top surface 30 to form a portion of the sides 40. Fabric 20 extends upwardly at approximately right angles from the bottom surface 50 to form another portion of sides 40. The portions 22, 24 of fabric 20 forming sides 40 are in juxtaposed relationship about edges 44. A closure device 42 is fixed about and to the juxtaposed portions 22, 24 of fabric 20 forming a secure closure between the fabric 20 of each the top surface 30 and the bottom surface 50. Piping 46 extends along the edges 44 of cushion 10. The shell 26 of cushion 10 includes a fold line 62 located transversely across the approximate middle 60 of the length 64 of cushion 10. Fabric 20 is stitched along fold lines 62 forming a seam 66 to separate cushion 10 into two halves.

In anther embodiment of the present invention, fabric 20 of top surface 30 extends only to the edge 44 of the top surface 30, and fabric 20 extends upwardly at approximately right angles from the bottom surface 50 to meet the top surface fabric at the edge 44 of the top surface 30. In still other embodiments, fabric 20 of top surface 30 extends downwardly at approximately right angles from the top surface 30 to the edge 44 of the bottom surface 50, and fabric 20 extends only to the edge 44 of the bottom surface 50 to meet the top surface fabric at the edge of the bottom surface 50. In embodiments having a solid piece of fabric forming side portions of the cushion, piping can be applied to the juncture of fabric 20 at edges 44.

In another embodiment of the present invention, cushion 10 also includes a picture 32 and text 34 as aids to prayer, particularly while a person is kneeling on cushion 10. Cushion 10 also includes a button or snap 36 located near one end of the length 64 and a corresponding eyelet 38 located at the opposite end of cushion 10 from button 36. When cushion 10 is folded in half along fold line 62, eyelet 38 slides over button 36 to close cushion 10 for ease of transport and/or storage.

In embodiments of the present invention, the shell top surface 30 of cushion 10 comprises plastic, leather, vinyl, denim, and/or other material suitable for a cushion. In a preferred embodiment, the top surface 30 is covered with a soft material, such as fabric and/or a soft leather. Such materials allow for a soft contact area with the user's knees yet will provide friction between the user and the cushion to prevent slips and falls.

In embodiments, the shell bottom surface 50 comprises plastic, leather, vinyl, denim, and/or other waterproof materials. The bottom material is preferably abrasion-resistant to withstand repeated pressure and contact with flooring surfaces. In embodiments, the shell bottom surface 50 comprises material(s) that are soil-resistant and easily cleanable. This feature is particularly advantageous due to repeated contact of a cushion with dust and dirt on a floor. In addition, material used for the shell bottom surface 50 can comprise a non-skid type of material.

In another embodiment, the outer shell 26 of cushion 10 comprises material that is waterproof and stain-proof. The cushion may be used in a variety of circumstances including use at home, at church, outdoors, and in conjunction with the consumption of food or beverages. Some of these uses, particularly where the cushion will be subjected to the outdoor elements, benefit from increased protection of the outer shell 26. Alternatively, the cushion can be constructed of materials which are not waterproof or stain-proof and are subsequently coated with a protective material such as Scotch Guard™ or other water repellant and/or fabric sealant.

In embodiments of the present invention, the top surface 30 comprises graphic displays, such as embroidering with various designs or text 34. Text 34 can include religious phrases or other inspirational words and symbols. The words and phrases remind the cushion user of words in a particular prayer and assist the user in recalling other aspects of worship, such as a Bible verse or spiritual song.

Embodiments further comprise pictures or drawings 32 displayed on the top surface 30 of cushion 10. Such pictures or drawings 32 can be religious and/or inspirational in nature and provide a cushion user with an aid to worship. In a preferred embodiment, the combination of pictures and lettering comprise a theme to the cushion. Examples of themes include, a scene depicting the praying hands alongside the Lord's Prayer, and the American Flag with the Pledge of Allegiance.

In an embodiment of the present invention, cushion 10 comprises a foldable version. In this embodiment, cushion 10 comprises a joint or seam 66 down the middle 60. Cushion 10 includes a means to keep the folded cushion closed, such as a button 36 and eyelet 38. Other means to keep the cushion closed include, a clasp, a hook and loop type fastener, or a buckle.

In yet another embodiment of the present invention, cushion 10 further comprises substantially two halves with a seam 66 in the middle 60 allowing the halves to fold together. There may be less cushioning material at the seam 66 to allow the halves to fold without bunching the cushion 10. The seam 66 is preferably reinforced with additional material 68 and stitching to withstand repeated folding and unfolding.

Figure 2:
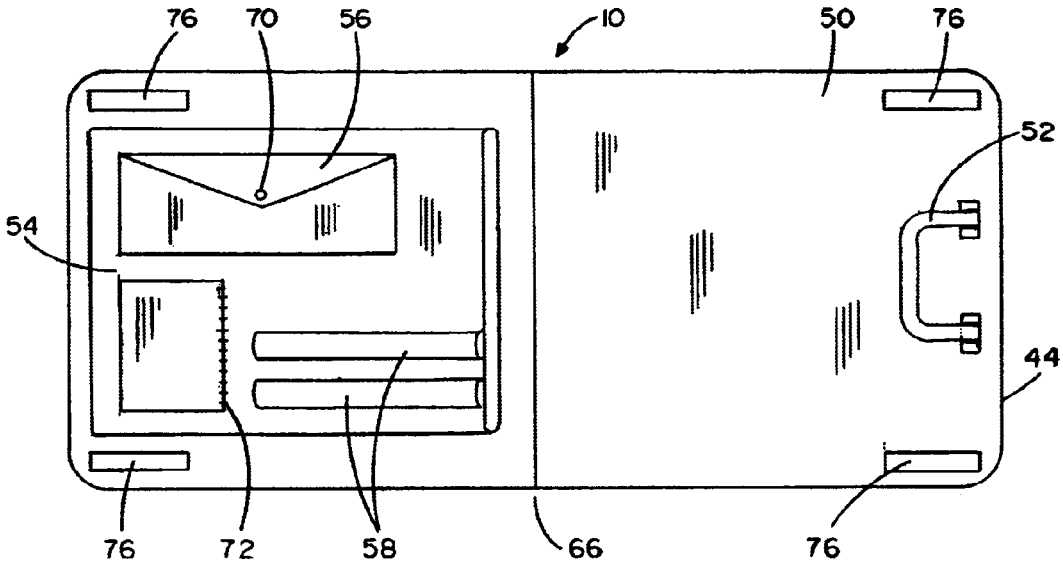
FIG. 2 is a bottom view of a cushion in an embodiment of the present invention.

FIG. 2 is a bottom view of another embodiment of the present invention. Cushion 10 includes a handle 52 to facilitate carrying. Handle 52 is located near one of the edges 44 of cushion 10. Alternatively, handle 52 is located along the spine, or seam 66. Embodiments of a handle 52 comprise fabric, vinyl, leather, and/or plastic. In embodiments handle 52 is recessable into part of cushion 52 such that handle 52 can be stored within cushion 10 when not in use.

Embodiments of cushion 10 according to the present invention include, at least one pocket incorporated into the outer shell of cushion 10 to store accessories associated with the cushion's intended use, such as praying. Pockets 54, 56, 58 comprise fabric, vinyl, plastic, denim, or leather and may or may not be made of the same material as cushion 10. Pockets 54, 56, 58 are preferably permanently fixed to cushion 10. In alternative embodiments, pockets 54, 56, 58 are removable from cushion 10, or may fold out from the body of the cushion. Pockets 54, 56, 58 can be closed through a variety of means, including, snaps 70, hook and loop-type fasteners, magnets, ties, buttons, zippers 72, and clasps.

Embodiments include pockets 54, 56, 58 having a variety of sizes to hold materials including, for example, bibles, pens, highlighters, prayer cards, prayer journals, reading glasses, candles, and incense. A pocket can be a photo pocket having a clear surface to allow a photograph to be placed inside the protective pocket and viewed through the clear portion. Pockets can be located on any surface of cushion 10. Additionally, pockets can be removable and replaceable on alternating sides of a cushion.

In other embodiments, top surface 30 of cushion 10 includes a pocket for storing and transporting a Bible and/or other worship aids. Such an embodiment may include no pockets on bottom surface 50. Top surface 30 in such embodiments may or may not include drawings 32 and/or designs or text 34.

In embodiments, bottom surface 50 is covered with a soft or slippery material, such as fabric. In such embodiments, small rubber pads 76 are applied to the bottom surface 50 of cushion 10 to provide increased contact with the floor and prevent cushion 10 from moving while in use.

Figure 3:
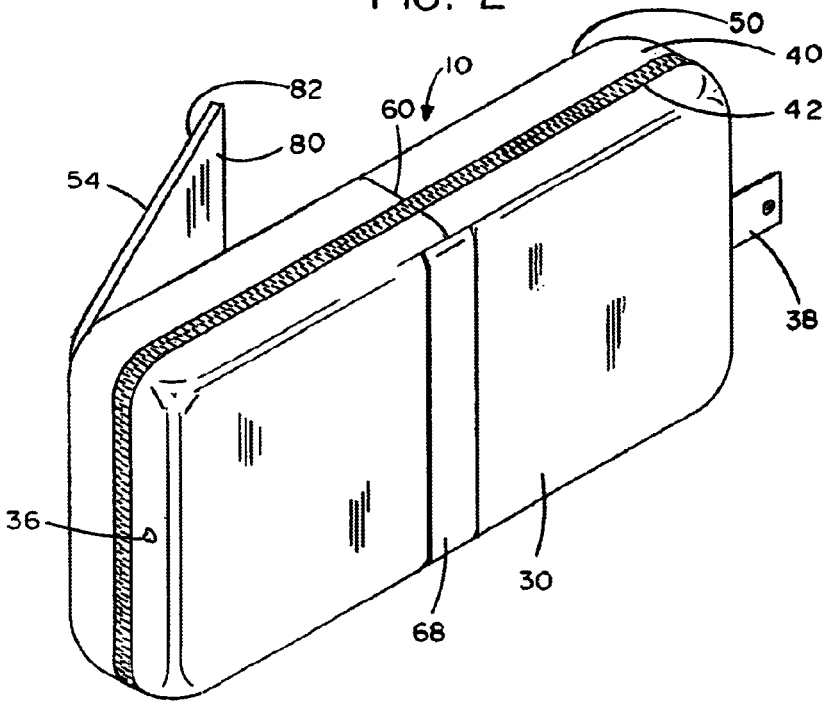
FIG. 3 is side perspective view of a cushion in an embodiment of the present invention.

FIG. 3 shows a side perspective view of cushion 10 of an embodiment the present invention. The outer shell includes a means 42 for opening and closing the shell, such as a zipper, hook and loop-type fastener, buttons, snaps, or other closure means, along one or more of the sides 40 of cushion 10. The cushioning material is removable from the outer shell by opening the closure means 42 and sliding the cushioning material out of the outer shell. A means for removing the cushioning from the shell facilitates cleaning the outer shell.

In an embodiment with a fold-out pocket 54, the pocket 54 is attached to the outer shell 26 of cushion 10 such that pocket 54 acts as a flap on the outer shell 26 of cushion 10. Smaller pockets can be attached to both the inner side 80 and outer side 82 of the fold-out pocket 54, as well as to the outer shell 26 of cushion 10, where cushion 10 is covered by a fold-out pocket 54. The folding nature of this type of pocket allows for easy removal and retrieval of items within pocket 54 and increased surface area for additional pockets.

Figure 4:
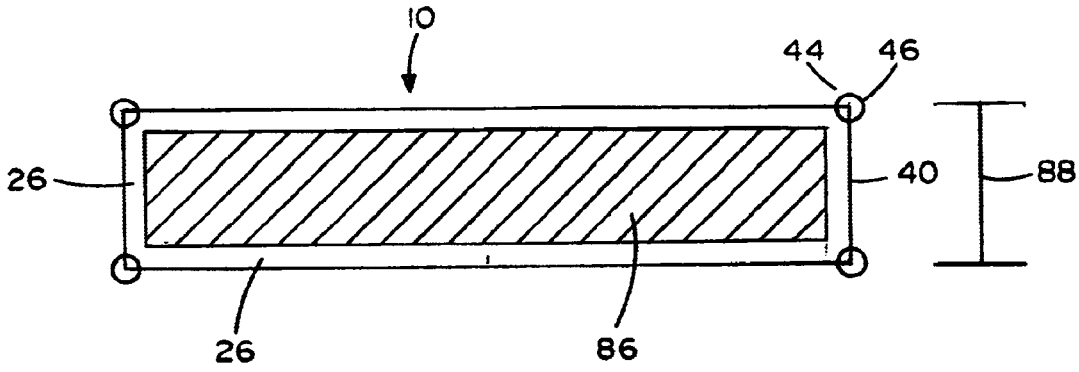
FIG. 4 is a cross-sectional view of a cushion in an embodiment of the present invention.

FIG. 4 is a cross-sectional view of cushion 10 of an embodiment of the present invention. Cushioning material 86 substantially fills the outer shell 26 preferably comprising a high-density, fire resistant foam. Other means of cushioning, such as fibrous pillow filling, animal down, and soy husks can be used effectively. The cushioning material 86 is preferably lightweight and soft to protect the user's knees, yet firm enough to support the weight of the user without yielding to the floor. In order to keep cushion 10 from becoming too large, a high-density foam is preferable. A high-density foam cushioning material 86 effectively absorbs weight of a user, and will return to its original shape once pressure is no longer applied. The preferred thickness 88 of such cushioning material is 1.5–3.0 inches. FIG. 4 also illustrates the piping 46 that runs along the outer edges 44 of cushion 40.

In other embodiments, a cushion includes attachments for a shoulder strap to provide an additional means for carrying the folded cushion. Two attachments can be located along the fold or, alternatively, along the ends of the cushion to which a shoulder strap can be attached.

In embodiments of the present invention, the cushion may be rolled and stored as a cylinder. A hook and loop type fastener, or a strap and buckle, is provided to secure the cushion in the rolled position.

The present invention also includes embodiments having a cover to provide further protection for the cushion when not in use. The cover may be similar to a pillowcase or bag, and slip over the cushion to protect it from the sun, dust, tears, spills, and stains. The cover comprises fabric, vinyl, plastic, or other waterproof material. The cover can include designs displayed on it and have a variety of colors. Such designs can include pictures or graphics. In embodiments, the cover further includes words and/or symbols displayed on it, such as a religious verse or inspirational sayings.

The cover can include a means of closure, such as a string tie, hook and loop-type fasteners, or a zipper. The cover may also contain a shoulder strap to provide an additional means of carrying the folded cushion while in the cover. In a further embodiment, the cover is stored in a pocket on the outside of the cushion when the cushion is being used.

Figure 5:
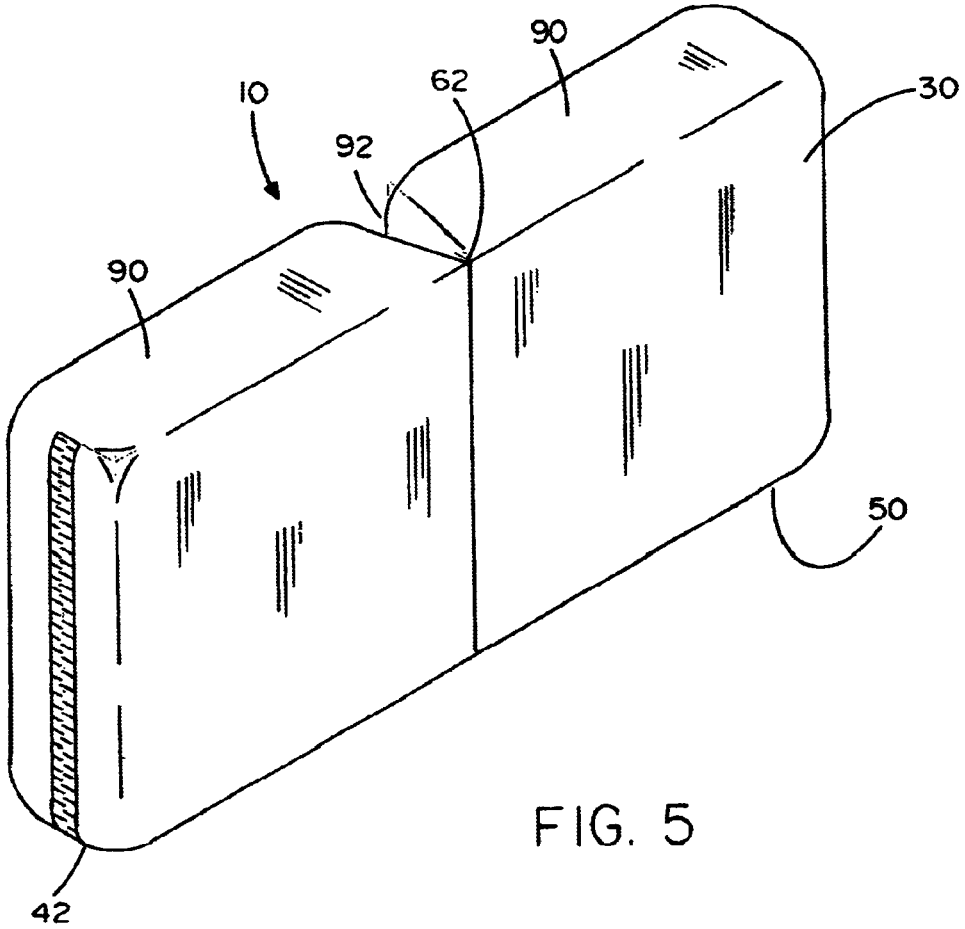
FIG. 5 is a side perspective view of a cushion in another embodiment of the present invention.
Figure 6:
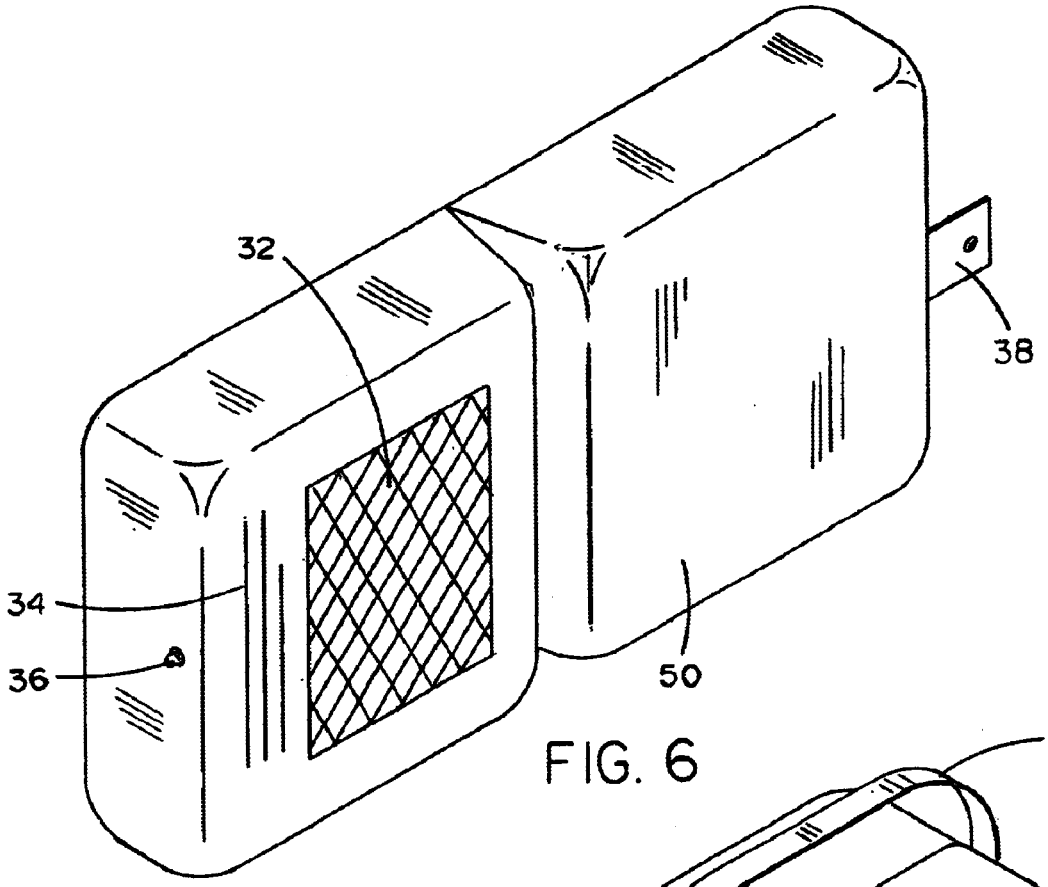
FIG. 6 is a side perspective view of a cushion in another embodiment of the present invention.

FIGS. 5 and 6 show a top and bottom perspective view of an embodiment of cushion 10 of the present invention. In this embodiment of the present invention, cushion 10 is comprised of two cushioning pads 90 substantially surrounded by a shell. The two cushioning pads 90 surrounded by a shell, meet and are attached to one another along the fold 62. In another embodiment of the present invention, the cushioning pads are surrounded by a single shell that substantially surrounds the pads and connects them through a common piece of fabric at the location of the fold 62. These two cushion embodiments, provide a gap, or space in the area of the fold 62 that allows the cushion 10 to fold without material bunching along the fold line 62. FIG. 6 shows another embodiment of the two cushion design with pictures 32, graphics 34 and closure means 36, 38 as described herein.

Figure 7A:
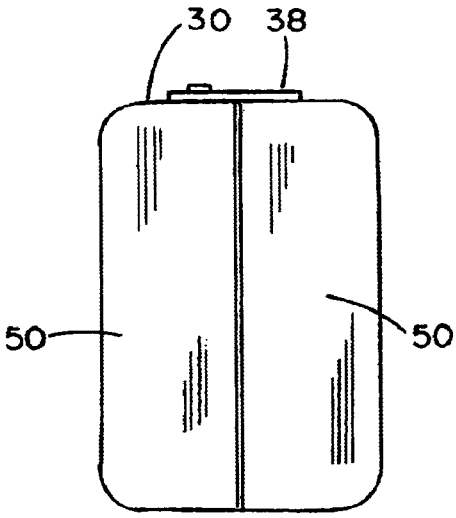
FIG. 7A is a side view of a folded cushion in another embodiment of the present invention.
Figure 7B:
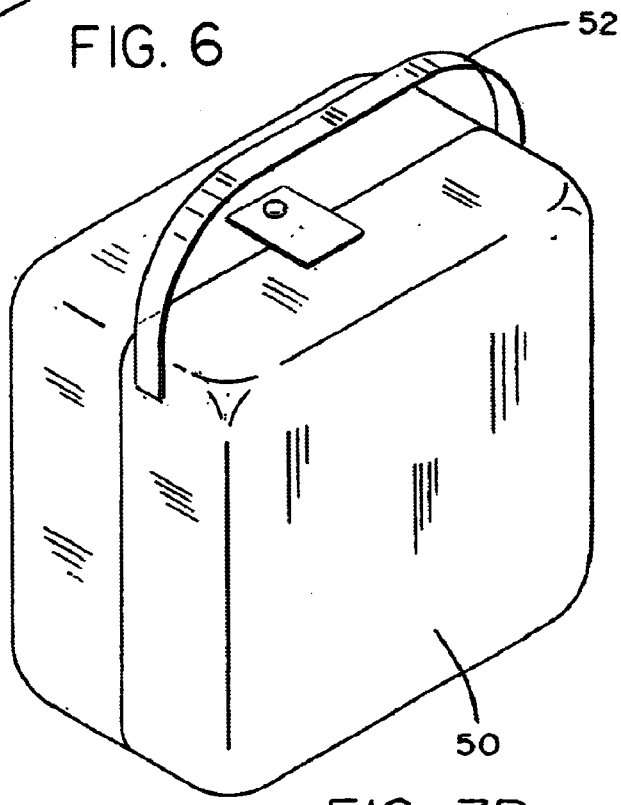
FIG. 7B is a perspective view of a folded cushion in another embodiment of the present invention.

FIGS. 7*a* and 7*b* show an embodiment of the present invention in the folded position. Further closure means 38 and a carrying strap 52 are provided.

Figure 8A:
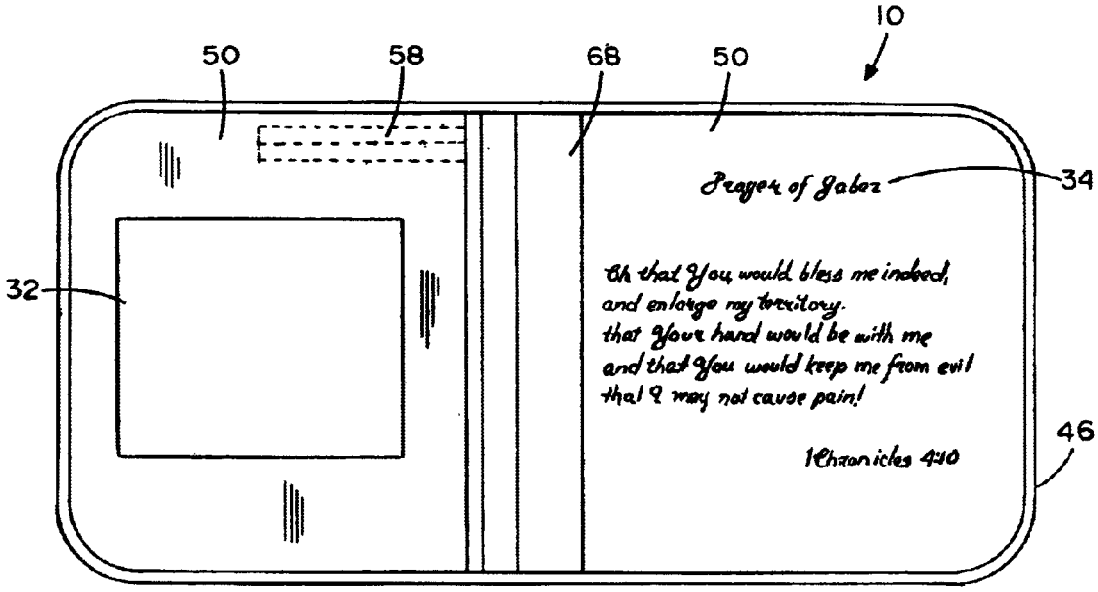
FIG. 8A is a bottom view of a cushion in another embodiment of the present invention.
Figure 8B:
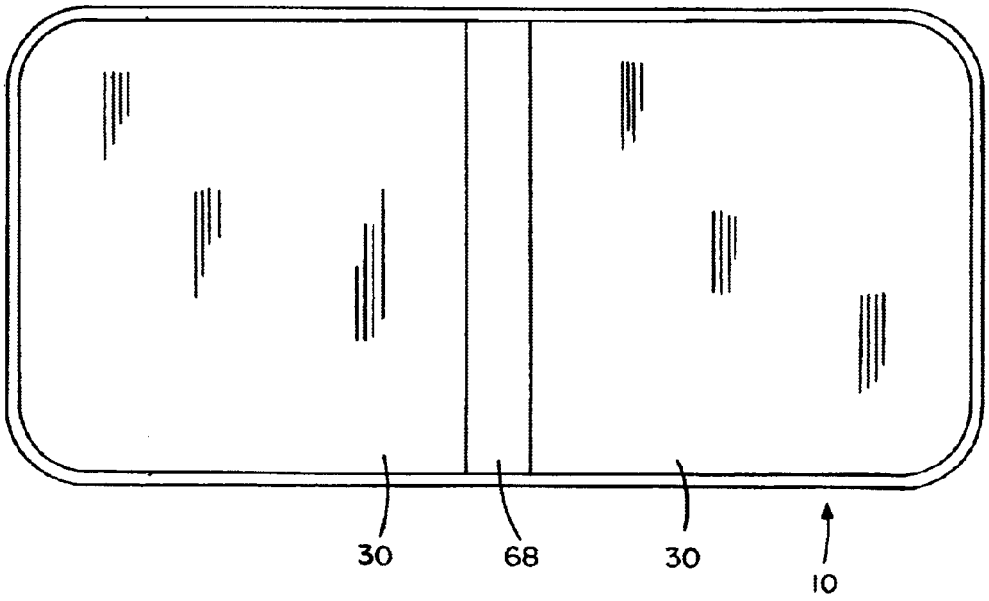
FIG. 8B is a bottom view of a cushion in another embodiment of the present invention.

FIGS. 8*a* and 8*b* show the top and bottom of a cushion of the present invention. The cushion comprises reinforcement along the fold 68 on the top 30 and bottom 50 of the cushion 10. On the bottom 50 of the cushion 10 a passage from the bible 34 is illustrated, as well as a picture or graphic 32. Pockets 58 for pens or pencils are provided as well as piping 46 along the edges of the cushion 10.

Embodiments of a cushion according to the present invention comprise: a cushioning pad; a shell having a top, a bottom, and at least three sides, the shell enclosing the cushioning pad; and worship-related graphics displayed on the shell top. The cushioning pad comprises a lightweight, high-density foam, which can also be a fire-resistant material. In preferred embodiments, the cushioning pad comprises a thickness of 1.5 to 3 inches.

In embodiments, the top and the bottom of the cushion meet along the sides of the cushion, and include piping along the edges of the top and/or bottom, or along the sides where the top and the bottom meet. The shell can include a means for opening and closing at least one side of the shell for inserting the cushioning pad into and removing the cushioning pad from the shell. In embodiments, the means for opening and closing the at least one side of the shell comprises a zipper.

A cushion of the present invention includes embodiments in which the shell comprises a pocket. The pocket can include a means for displaying selected contents. The cushion can further include a means for closing the pocket. In particular embodiments, the pocket is removably attached to the cushion.

In the present invention, embodiments of worship-related graphics include pictures, words, prayers, other inspirational displays, and combinations of such graphics.

Embodiments of a cushion of the present invention include a top comprising a fabric, leather, and/or a polymeric material. Embodiments of a cushion bottom can comprise a fabric, leather, and/or a polymeric material. In addition, a pocket can comprise a fabric, leather, and/or a polymeric material. Materials comprising the top, the bottom, and a pocket may be the same or different. In embodiments, the top and the bottom each comprise a waterproof material. In other embodiments, the top and the bottom each comprise a soil-resistant material. In yet other embodiments, the bottom comprises an abrasion-resistant material. In addition, the shell of a cushion of the present invention can include a shell protecting agent.

In embodiments of the present invention having a pocket, the pocket further comprises a closure device. The pocket closure device can include a set of complementary snaps, hook and loop fasteners, magnets, a draw-tie, a button and an eyelet, a zipper, and/or a clasp.

In embodiments, a cushion further comprises a fold line located approximately equidistantly between at least two of the at least three sides, wherein the cushion is foldable upon itself along the fold line. Such an embodiment can also include a seam disposed through the top and the bottom of the shell and the cushioning pad along the fold line, such that the fold line is reinforced. Embodiments further comprise a means for securing the cushion in a folded position. The means for securing the cushion in a folded position can include a set of complementary snaps, hook and loop fasteners, magnets, a draw-tie, a button and an eyelet, a zipper, and/or a clasp.

Embodiments of a cushion in the present invention include a handle and/or an attachment for a shoulder strap, for transporting the cushion. Other embodiments comprise a cover for transporting and storing the cushion. The cover comprises a fabric, leather, and/or a polymeric material. The cover can also include a means for closing the cover about the cushion. Embodiments of the cover have worship-related graphics displayed on the cover.

Although the present invention has been described with reference to particular embodiments, it should be recognized that these embodiments are merely illustrative of the principles of the present invention. Those of ordinary skill in the art will appreciate that the protective cushion of the present invention may be constructed and implemented in other ways and embodiments. Accordingly, the description herein should not be read as limiting the present invention, as other embodiments also fall within the scope of the present invention.

What is claimed is:

1. A protective cushion comprising:

a cushioning pad foldable upon itself into a closed position;

a shell comprising a top and a bottom, the shell substantially surrounding the cushioning pad;

graphics disposed on at least one of the top and the bottom of the shell;

a seam dividing the foldable cushioning pad in to substantially equal portions; and a closure means for securing the substantially equal portions in the folded together closed position, wherein at least one of the top or bottom of the cushion further comprises a fold out pocket such that the pocket is attached to the cushion on only one side and may fold out and away from the body of the cushion.

2. The protective cushion of claim 1, wherein the fold out pocket further comprises at least one smaller pocket thereon.

3. The protective cushion of claim 2, wherein the at least one smaller pocket comprises a pocket on the underside of the fold-out pocket.

4. The protective cushion of claim 1, wherein the cushion further comprises at least one of a handle and a shoulder strap.

5. The protective cushion of claim 4, wherein the at least one of a handle or a shoulder strap is attached along the seam of the folded cushion.

6. The protective cushion of claim 4, wherein the at least one of a handle or a shoulder strap is attached to an outer edge of the cushion.

7. A protective cushion comprising:

a cushioning pad foldable upon itself into a closed position;

a shell comprising a top and a bottom, the shell substantially surrounding the cushioning pad;

graphics disposed on at least one of the top and the bottom of the shell;

a seam dividing the foldable cushioning pad in to substantially equal portions;

a closure means for securing the substantially equal portions in the folded together closed position; and rubber pads on the bottom of the shell to contact the floor during use.

8. A protective cushion comprising;

a cushioning pad foldable upon itself into a closed position;

a shell comprising a top and a bottom, the shell substantially surrounding the cushioning pad;

graphics disposed on at least one of the top and the bottom of the shell;

a seam dividing the foldable cushioning pad in to substantially equal portions;

a closure means for securing the substantially equal portions in the folded together closed position; and a bag surrounding the cushion comprising at least one of a strap or handle.

* * * * *